United States Patent [19]

Nickerson

[11] Patent Number: 4,856,249

[45] Date of Patent: Aug. 15, 1989

[54] INSULATED BUILDING BLOCK

[76] Inventor: David L. Nickerson, 27 Leemond St., Wilbraham, Mass. 01095

[21] Appl. No.: 285,282

[22] Filed: Dec. 15, 1988

Related U.S. Application Data

[63] Continuation of Ser. No. 136,474, Dec. 23, 1987, abandoned, which is a continuation of Ser. No. 31,141, Mar. 24, 1987, abandoned, which is a continuation of Ser. No. 881,513, Jun. 30, 1986, abandoned, which is a continuation of Ser. No. 758,577, Jul. 24, 1985, abandoned, which is a continuation of Ser. No. 536,327, Sep. 29, 1983, abandoned.

[51] Int. Cl.[4] ..... E04B 1/88

[52] U.S. Cl. ..... 52/405; 52/407; 52/309.2; 52/309.13

[58] Field of Search ..... 52/405–407, 52/589, 591, 373, 375, 309.2, 309.13

[56] References Cited

U.S. PATENT DOCUMENTS

| | | | |
|---|---|---|---|
| 1,486,935 | 3/1924 | Swanson et al. | 52/375 |
| 1,668,348 | 5/1928 | Anderson | 52/373 |
| 2,176,986 | 10/1939 | Briscoe | 52/591 |
| 2,684,589 | 7/1954 | Perreton | 52/589 |
| 3,204,381 | 9/1965 | Perreton | 52/407 |
| 3,704,562 | 12/1972 | Grants | 52/405 |

FOREIGN PATENT DOCUMENTS

| | | | |
|---|---|---|---|
| 2440466 | 3/1976 | Fed. Rep. of Germany | 52/405 |

*Primary Examiner*—James L. Ridgill, Jr.

*Attorney, Agent, or Firm*—McCormick, Paulding & Huber

[57] ABSTRACT

An improved masonry building block has rectangular side walls and a pair of connecting arms spaced from each other and from the ends of the block. The arms are notched adjacent one side wall to receive an insulating insert. A rectangular insulating insert has cooperating notches which receive the arms with portions of the insert disposed in the arm notches. Both the block side walls and the insert have marginal flanges which overlap and interlock with contiguous blocks and inserts in a composite wall structure. A multi-part insert is provided and has a first portion where it resides within the block for transport and a second position where it projects into overlapping relationship with a subadjacent insert.

8 Claims, 9 Drawing Sheets

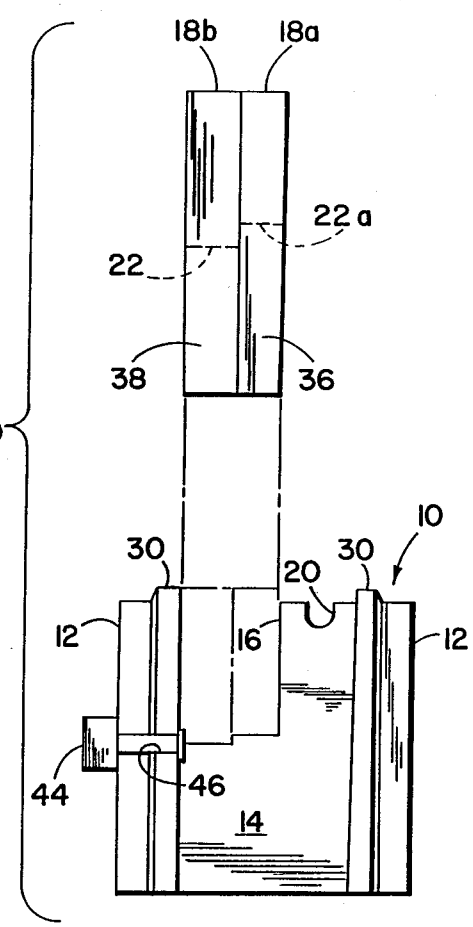
FIG. 3
FIG. 2
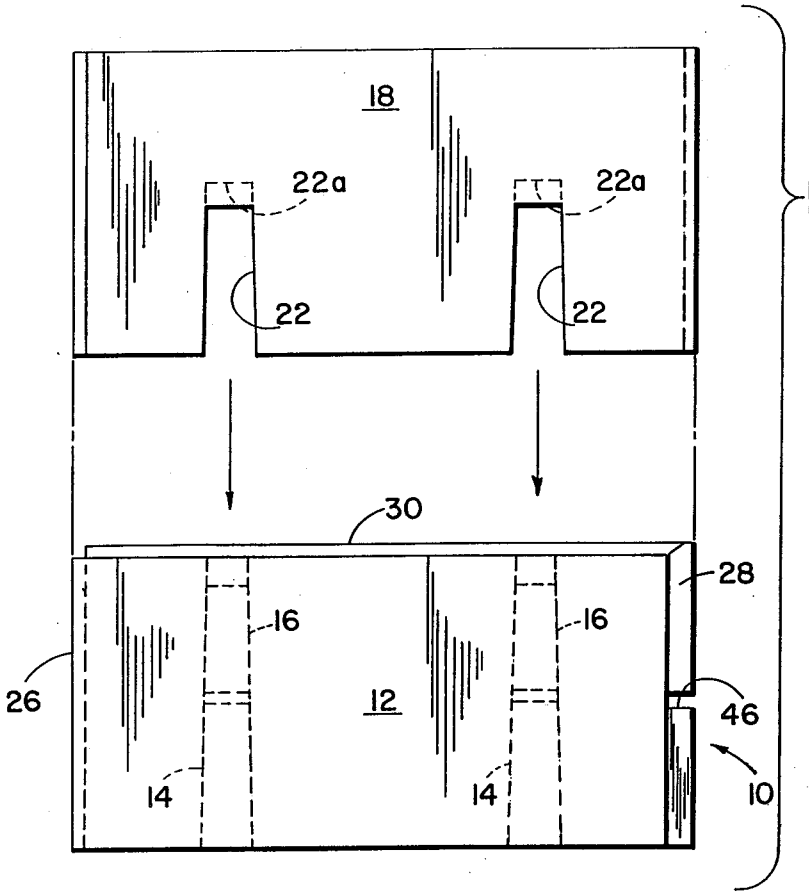

INSULATED BUILDING BLOCK

This is a continuation of Ser. No. 136,474, filed Dec. 23, 1987, which is a continuation of Ser. No. 31,141, filed Mar. 24, 1987, which is a continuation of Ser. No. 881,513, filed June 30, 1986, which is a continuation of Ser. No. 758,577, filed July 24, 1985, which is a continuation of Ser. No. 536,327, filed Sept. 29, 1983, all now abandoned.

BACKGROUND OF THE INVENTION

Insulated masonry building block construction has varied widely in form. Loose insulation is sometimes introduced in situ after a wall has been constructed or partially constructed of masonry building blocks. Insulation has also been molded directly in the cavities of such blocks. Further, various special types of blocks have been provided with insulation mounted internally or secured externally.

Thereto, one form of block insulation, which has gained wide commercial acceptance, is disclosed in U.S. Pat. No. 3,885,363 to Richard W. Whittey entitled INSULATED BLOCK and in U.S. Pat. No. 4,027,445, to David L. Nickerson entitled INSULATED BLOCK. As disclosed therein, preformed insulating inserts are introduced to the cavities of conventional masonry building blocks at the block plant after the blocks have been formed and the blocks may thereafter be handled during transport and construction in the conventional manner of uninsulated blocks. Obvious and substantial advantages in efficiency, convenience and economy are thus achieved.

Even with the last above mentioned insulating technique however, the U-Values of the combined building block and insert may not be as low as desired for some installations. The core areas are effectively insulated by the insulating inserts but the mortar joints and the transverse webs, usually three in number and, extending between inner and outer side sections, result in substantial heat transfer conductively therethrough. To date there has been no effective solution to this problem. There are also of course other known problems with masonry building blocks such as the migration of moisture therethrough.

It is the general object of the present invention to provide an improved insulated masonry building block wherein a significant improvement in U-Values is achieved in the range 0.05 to 0.10 BTU/FT$^2$HRF°, wherein the insulation is applied at the block plant with substantial savings in cost, and wherein substantial improvement is achieved in reducing moisture migration or transmission through the blocks.

SUMMARY OF THE INVENTION

In fulfillment of the foregoing object, a preformed masonry building block is provided with a pair of laterally spaced longitudinally extending vertically disposed side walls each of a generally rectangular configuration viewed laterally and each of generally rectangular cross-sectional configuration. The walls cooperatively define a vertically open generally rectangular space therebetween and a pair of vertically disposed generally rectangular and laterally extending connecting arms engage the respective inner surfaces of the walls whereby to secure the walls in relatively fixed position. The arms are spaced longitudinally from each other and from the ends of the walls and each arm includes a vertically open notch adjacent a side wall for receiving an insulating insert. The insulating insert is of a light weight thermal insulating and fire retarding material and has an external configuration which is generally rectangular with a pair of spaced vertically open notches respectively for receiving portions of the connecting arms of a block when the inert is disposed internally of and adjacent a wall of the block and entered vertically in the notches in the arms of the block. The insert is generally coextensive with the side walls of the block and has no portion thereof which projects beyond the walls of the block when so disposed in the block. Thus, the insert can be introduced to the interior of the block at the block plant and with the insert confined within the outline of the block, transport to the construction site can be readily effected without damage to the insert.

Both the block side walls and the insulating insert have overlap and interlock means along at least each marginal end portion thereof so as to provide for overlapping and interlocking relationship between each block wall and insert and horizontally contiguous block walls and inserts in a structural wall or the like formed of similar blocks and inserts. The overlap and interlock means take the form of narrow reduced thickness marginal flanges extending along the edges of the side walls of the block and the edges of the generally rectangular insulating insert. More particularly, the flanges on the insert result from a multi-part planar construction thereof. The insert is divided along a plane substantially at its midpoint and parallel with its major area opposing surfaces and the parts thereof are adapted for relative slidable movement so as to be arranged in a first position wherein both parts reside wholly within the rectangular outline of the side walls of an associated block. In a second position of the insert parts, one of the parts is moved relative to the other in a sliding movement so as to project vertically into overlapping and interlocking relationship with a vertically adjacent insert. When the said one part of the insert has been so moved and when similar parts of adjacent inserts are so moved the insulating inserts enjoy a quadri-lateral overlapping and interlocking relationship with all contiguous inserts thereabout in a structural wall formed of similar blocks and inserts. This results in a substantial improvement in insulating properties with total insert coverage of the side walls of the block except for the limited connecting arm cross-sectional areas. The cross-sectional areas are so designed as not to exceed about 10% of the total face or wall area of the building block in a substantial improvement in U-Value is thus achieved. The overlapping and interlocking of the inserts also substantially reduces moisture transmission or migration through the building blocks.

It is also to be noted that the multi-part sliding inserts accommodate building blocks having flanges at opposite ends and a flange at the top thereof but with a flat bottom surface. The building blocks are thus adapted for molding in conventional molds and using conventional molding techniques and yet the advantages of insert installation at the block plant, transport with no projecting portions or overhanging of inserts, and eventual use of the inserts in quadri-lateral overlapping and interlocking engagement is achieved.

BRIEF DESCRIPTION OF THE DRAWINGS

FIG. 2 is an exploded side view similar to FIG. 1, FIG. 3 is an exploded end view similar to FIG. 1.

DESCRIPTION OF THE PREFERRED EMBODIMENTS

Directional and or geometrical terms such as "top", "bottom", "side", "lateral", "horizontal", "longitudinal", "vertical", etc. are used freely hereinbelow but it will be understood that such terminology is employed for convenience of description only and is not to be regarded as in any way limiting the invention in the specification and the claims which follow.

Figure 1:
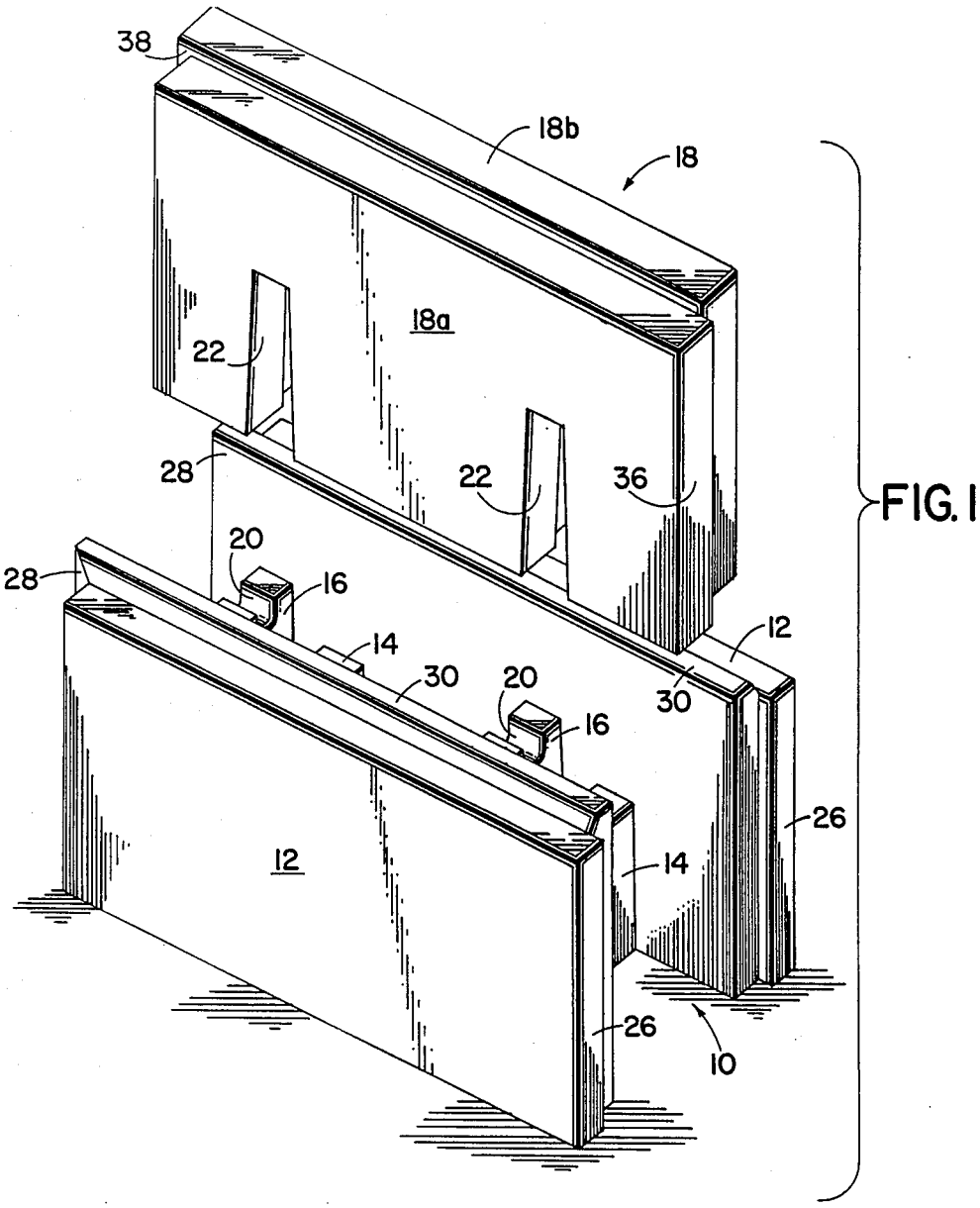
FIG. 1 is an exploded perspective view of an improved insulating building block with the insulating insert disposed vertically above the block and ready for downward entry to its position within the block.

Referring particularly to FIG. 1, an improved insulated building block indicated generally at 10 has a pair of laterally spaced longitudinally extending vertically disposed side walls 12,12 each of generally rectangular cross-sectional configuration. The walls 12,12 cooperatively define a vertically open generally rectangular space therebetween and a pair of vertically disposed generally rectangular and laterally extending connecting arms 14,14 extend across said space whereby to secure the walls in relatively fixed position. The arms 14,14 are spaced longitudinally from each other and from the ends of the walls as best illustrated in FIG. 2, and each arm includes a vertically open notch 16, FIG. 3 and 4, adjacent a side wall 12 for receiving an insulating insert indicated generally at 18. The notch 16 opens upwardly as shown and such construction is presently preferred. Each arm 14 is also shown with a small arcuate notch 20 which is spaced downwardly from the top of an adjacent wall 12 and which may serve as a shelf for the horizontal extension of cables, conduits, reinforcing bars, etc.

The insulating insert 18 is of a light weight thermal insulating and fire retarding material and has an external configuration which is generally rectangular as illustrated. The insert also has a pair of spaced vertically downwardly open notches 22,22 FIGS. 1 and 2 respectively for receiving portions of the arms 14,14 when the insert is disposed internally of and adjacent a wall thereof and entered vertically in the notches 16,16 in the arms 14,14, FIGS. 4, 8.

As will be observed in FIGS. 1-3, the insert 18 is constructed in two relatively slidable parts split along a plane parallel with the planes of its inner and outer faces. Thus, a lefthand portion of the insert 18*a* and a righthand portion or part thereof 18*b* may be identical in rectangular configuration or plan form as illustrated in FIGS. 2 and 3. Referring particularly to FIG. 3, it will observed that the insert 18 may be moved downwardly to a position shown in broken line form within the block 10 wherein the two portions or parts 18*a* and 18*b* of the multi-part insert are aligned or in a first position. In such first position of the insert parts, the insert is contained wholly within the outline of the side walls 12,12 of the block and there is no projection whatever of the insert beyond such side walls. Thus, in this position of the insert parts, the block and the insert may be transported in the usual manner with no danger of damage to the insert during transport.

Figure 4:
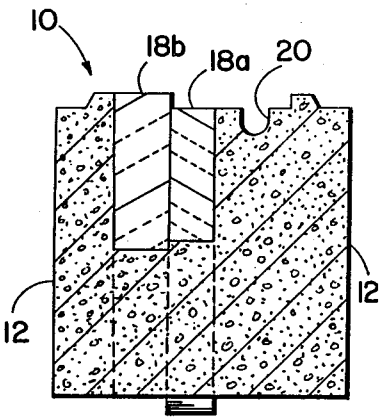
FIG. 4 is a vertical sectional view taken through a connecting arm of a block with the insulating insert entered to its position within the block.
Figure 8:
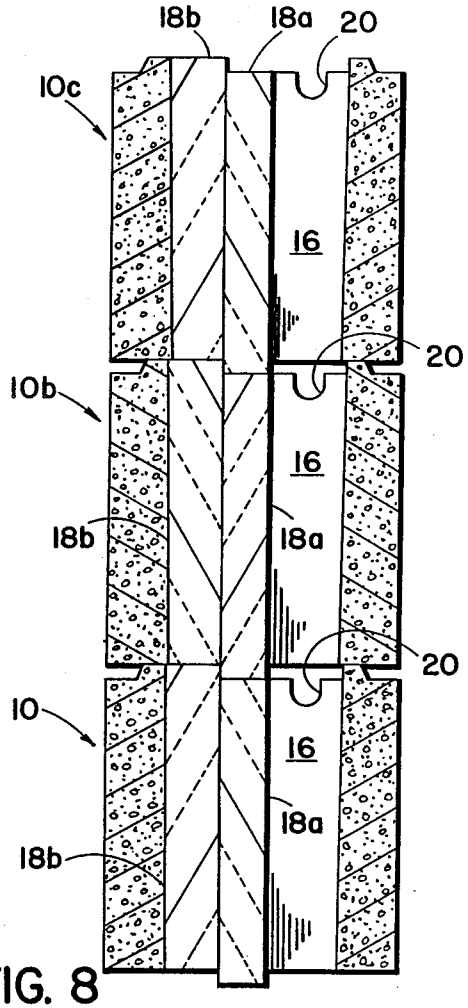
FIG. 8 is a vertical section taken generally as indicated at 8—8 in FIG. 7.

Still referring to FIGS. 2 and 3, it will be observed that a notch 22*a* in the righthand insert 18*a* is slightly deeper than the notches 22,22 in the aforementioned or lefthand side 18*b* of the insert. Two such notches 22*a*,22*a* are provided and are aligned with the notches 22,22 in the part 18*b* and the depth of the notches controls the downward movement of the part 18*a* as illustrated in FIG. 4. The notch 16 has a slightly elevated righthand portion in FIG. 3 but it will be apparent that the said notch may have a flat bottom portion and the degree of downward movement of the part 18*a* may be controlled merely by the depth of the notches in the said part. As shown in FIG. 4, the amount or degree of downward movement of the part 18*a* is approximately $\frac{3}{8}$ of an inch and this is dimensioned so as to correspond with the conventional thickness of a layer mortar between building blocks As best illustrated in FIG. 8, the downward movement of the parts 18*a* of the inserts 18 result in overlapping and interlocking relationship between inserts of vertically adjacent block and insert units. The lowermost insert part 18*a* is moved downwardly so as to project slightly beneath the bottom surface of the lowermost block 10 and it will be observed that a layer of mortar is normally provided at such location, the insert projecting into the layer of mortar.

From the foregoing it will be apparent that parts of a multi-part insert may be moved to a first position for transport wherein the insert 18 as a whole is substantially coextensive with side walls 12,12 of a block 10. After the inserts have been installed in the blocks at the block plant and transported to the job site in a conventional manner, the insert parts may be moved in a relative sliding movement as illustrated in FIG. 8 with the inserts in stacked relationship whereby to provide for the movement of the parts to their second positions and the overlapping and interlocking relationship thereof.

Figure 6:
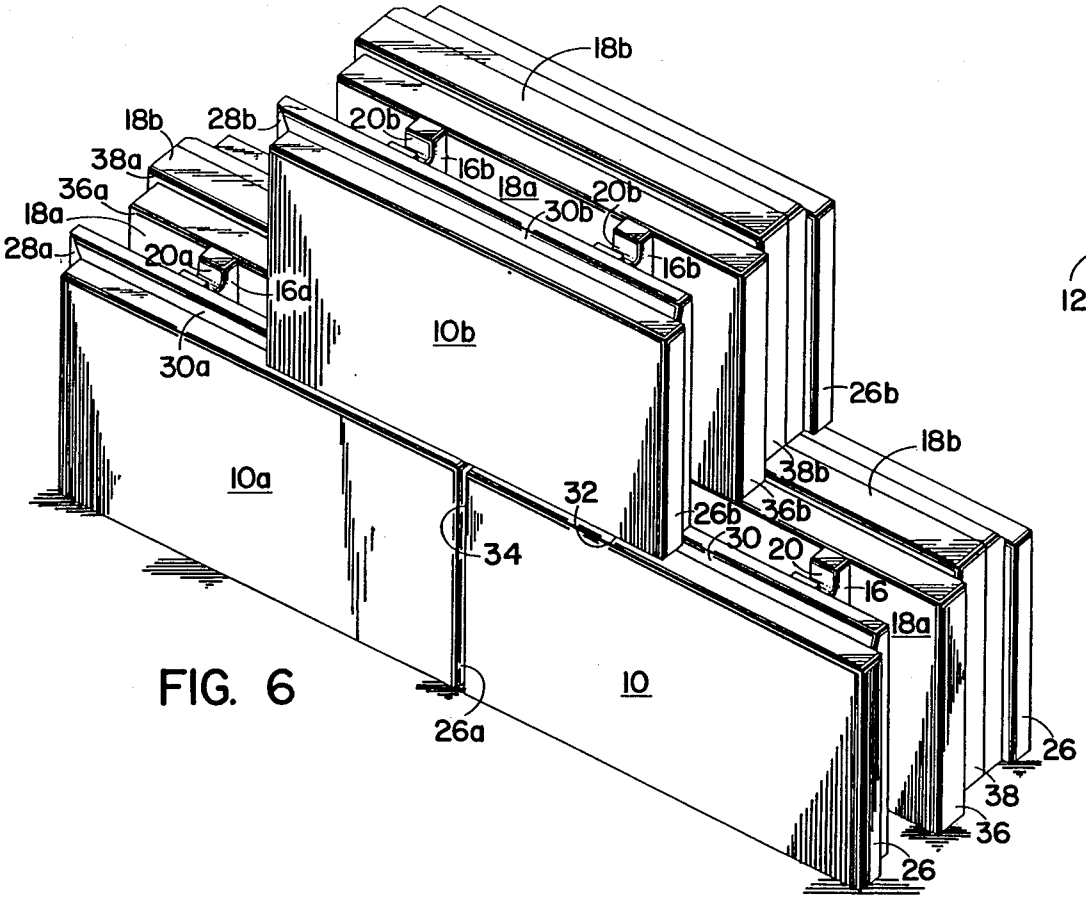
Figure 5:
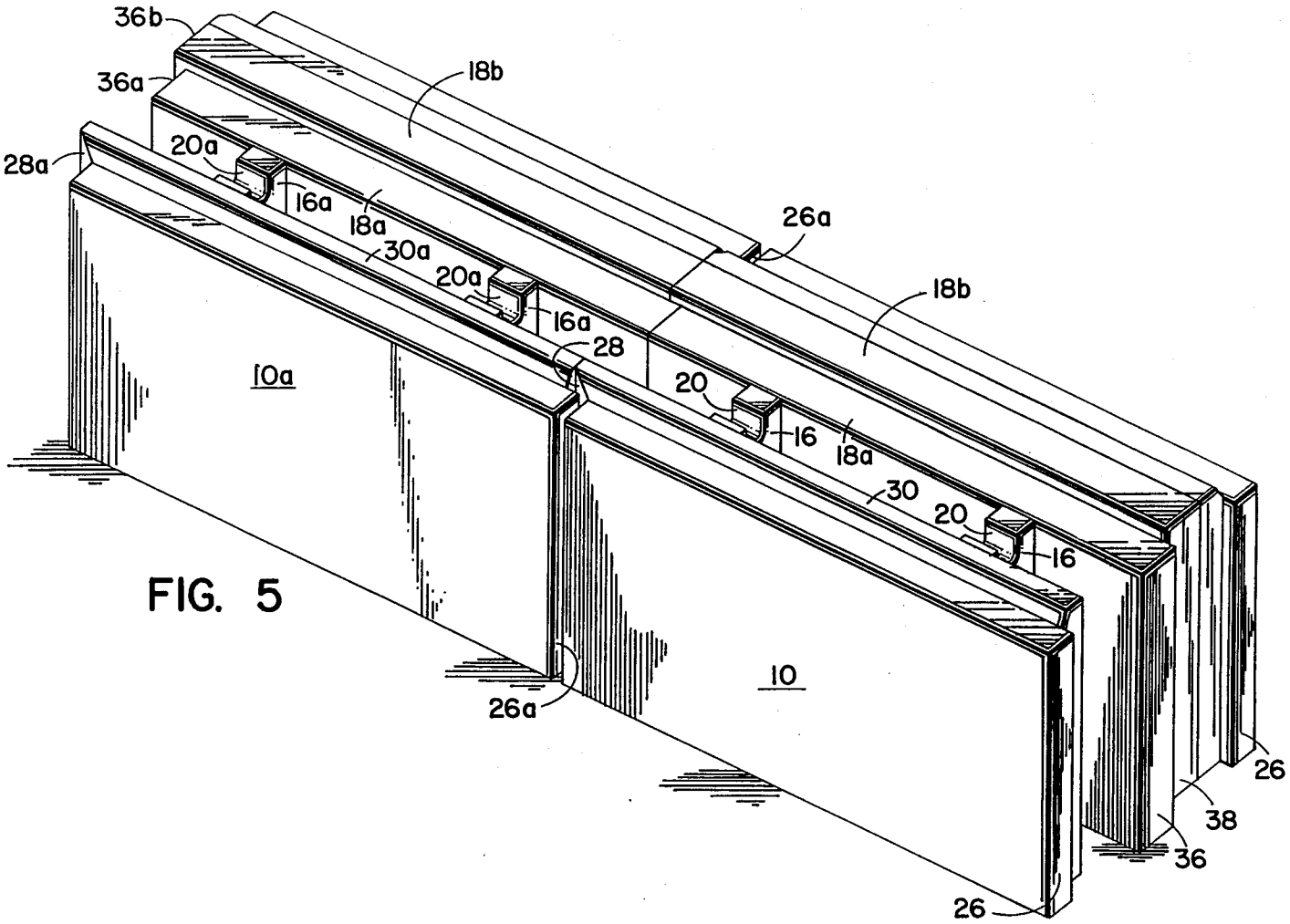
FIG. 5 is a perspective view showing first and second improved building blocks in end-to-end relationship with their insulating inserts in position, FIG. 6 s a perspective view similar to FIG. 5 but showing a third improved building block disposed atop the two blocks of FIG. 5 in the manner in which the blocks are stacked in the construction of a structural wall or the like, FIG. 7 is a perspective view of a portion of a wall several of the improved insulating blocks.
Figure 7:
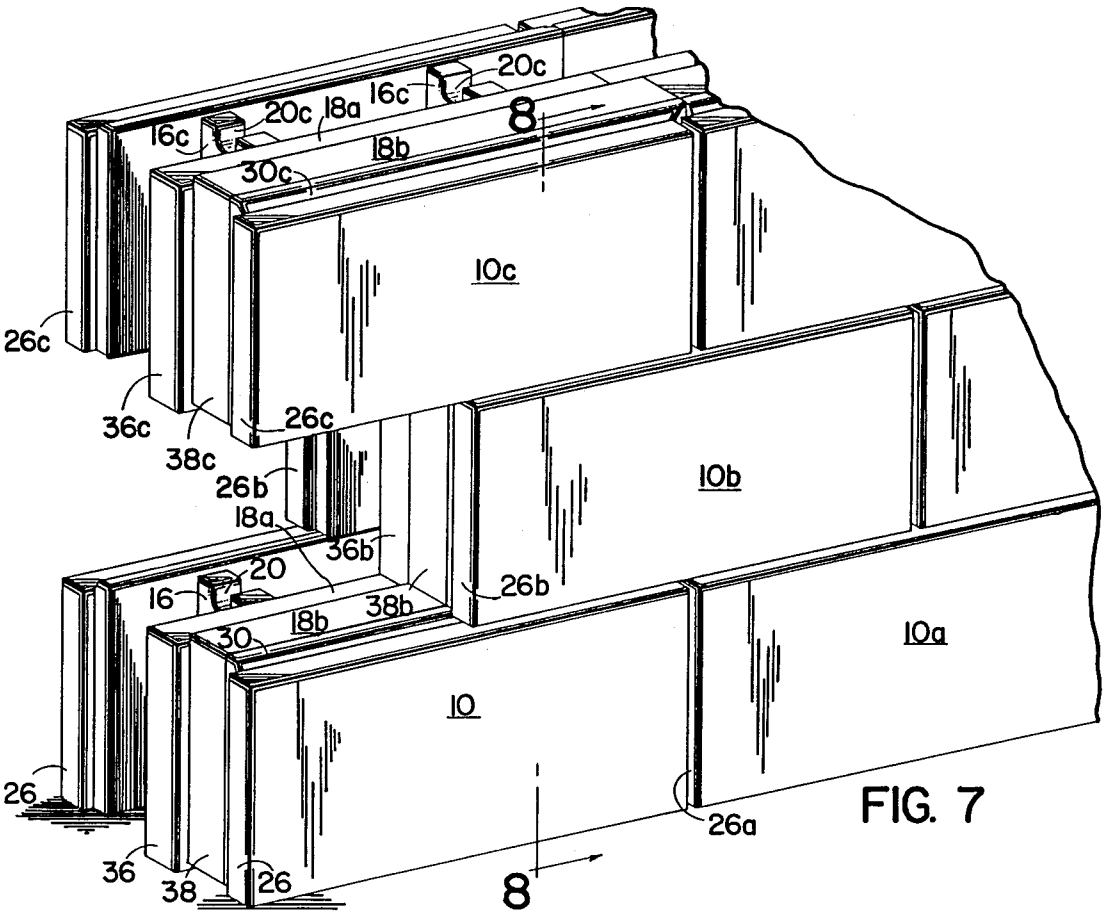

Returning to FIG. 1, and referring also to FIGS. 5, 6, and 7, both the improved masonry block and the insulating insert of the present invention have overlap and interlock means along each end marginal portion thereof so as to provide for horizontal overlapping and interlocking relationship between each wall and insert and horizontally contiguous block walls and inserts thereabout in a structural wall or the like formed of similar blocks and inserts. Referring first to the block side walls 12,12 in FIG. 1, reduced thickness narrow marginal flanges extend along each end edge portion of each wall with a projecting righthand flange 26 at the righthand end of each side wall. At a lefthand end of each side wall a similar flange 28 is provided and at the top of each wall a flange 30 is provided. At the bottom of each side wall a flat surface is provided and this eliminates the necessity for removable bars or mold parts and an expensive special molding technique. Accordingly, with the flat bottom surfaces of the side walls 12,12 standard molding procedures and standard mold construction may be employed in the manufacture of the blocks 10,10.

As will be seen the righthand end flanges 26,26 extend in a plane parallel with the outer surfaces of the side walls 12,12 and are of reduced thickness as mentioned. The opposite end or lefthand flanges 28,28 and the upwardly projecting flanges 30,30 also extend in a common plane and are coplanar with the inner surfaces of the walls 12,12 thus end flanges **26*a*,26*a* and a block 10*a* in FIG. 5 overlap and interlock with flanges 28,28 on a block 10 in FIG. 5. In FIG. 6 the blocks 10 and 10*a* have their top flanges 30,30*a* in engagement with the flat bottom surfaces of a block 10*b* and a mortar receiving groove 32 is thus defined between the blocks and extends horizontally in a uniform manner. The end flanges on the blocks 10,10*a* also define a uniform mortar receiving groove which extends vertically at 34** between the said blocks.

Figure 9:
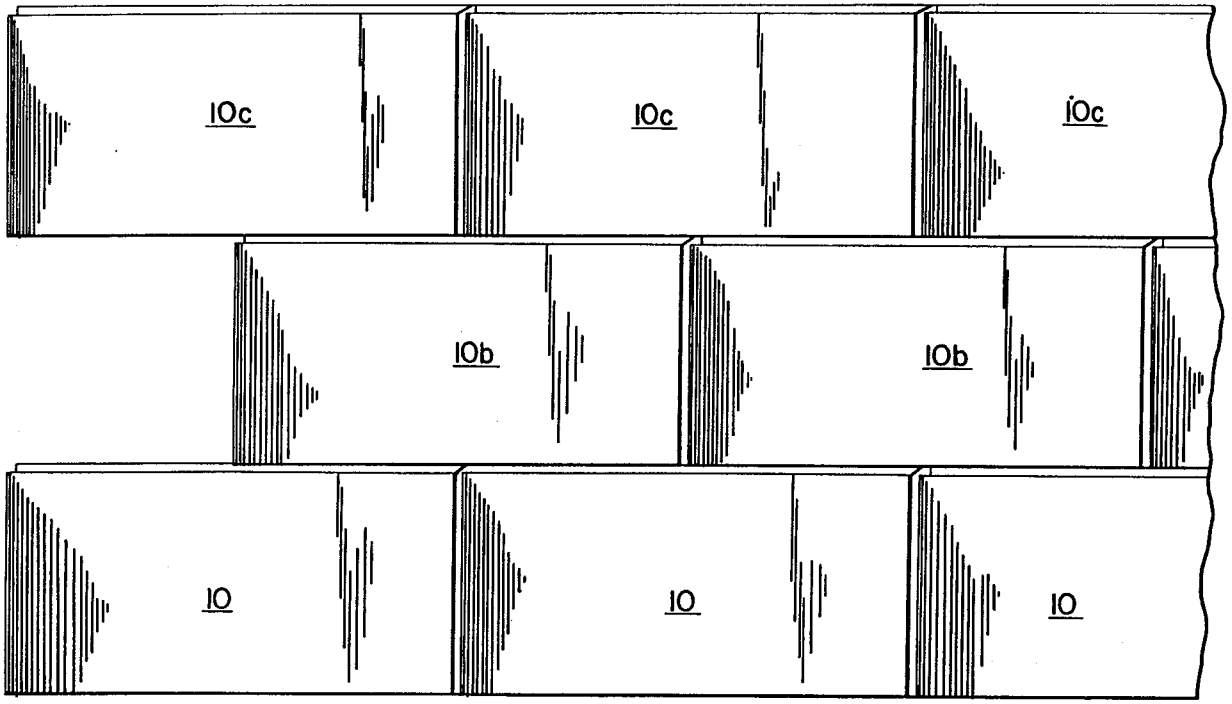
FIG. 9 is a front view of a wall showing several of the insulating blocks.
Figure 13:
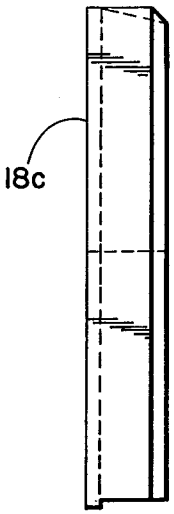
FIG. 13 is a righthand end view thereof.

As will be apparent blocks such as 10, **10*a*, 10*b* may be assembled and stacked in vertical relationship and in horizontal rows to construct a conventional masonry wall as in FIGS. 7 and 9. Each block has overlapping and interlocking engagement along each end marginal portion thereof with horizontally adjacent blocks. Uniform masonry grooves are defined as at 32,34** and inaccuracies in construction are thus avoided.

The insulating inserts 18,18 employed in the blocks enjoy quadri-lateral overlapping and interlocking engagement with all adjacent inserts thereabout with a righthand flange 36 interengaging with a lefthand flange 38. That is, referring to FIGS. 1, 2, and 5, it will be observed that the parts **18*a*,18*b* of the inserts 18,18 may be offset horizontally slightly so as to effectively define flanges 36,38. The flanges interengage and overlap as best illustrated in FIG. 5 and, combined with the vertical overlapping and interlocking of FIG. 8, quadrilateral overlapping and interlocking relationship is provided for. Thus, there is no lateral path for heat transfer through the inserts at the mortar joints or in fact at any point or area except through the notches in the inserts where the arms 14,14 reside. With cross-sectional area of the arms reduced to no more than 10% of the total face area of the improved building block, it is believed that U-Values in the range 0.05 to 0.10 $BTU/FT^2HRF°$ can be achieved. Further, the lateral transmission or migration of moisture is minimized if not eliminated with the overlapping and interlocking arrangement of the inserts 18,18**. Moreover a bevelled or tapered edge can be provided externally at one of the end flanges of an insert to provide for a vertical path for moisture to flow downwardly adjacent a side wall of a building block and this will further inhibit the transmission or migration of moisture into the core area of the blocks. Such a bevelled or tapered area can also be used to physically seal interlocking blocks with a moisture proofing material.

The density of the insert can also be made higher in the area where the insert fits into the notch portion of the arms. This can be done by making the fit of the insert sufficiently tight as to cause a squeezing action on the insert or a higher density may be provided by physically molding inserts to a higher density prior to insertion in the blocks. The structural assistance thus given the blocks by the inserts can be substantially enhanced.

It is also possible to provide a slightly bowed insert construction so that the inserts will be in tight frictional engagement and forced securely against the inner surfaces of the side walls of the blocks. This will tend to further enhance the prevention of moisture migration as well as the passage of heat, sound and even air into the inner core of the blocks.

Referring particularly to FIG. 3, it will be observed that a small stand-off element 44 may be provided and may be of a material suitable for nailing and or receiving and securely holding screw type or other connectors. The stand-off elements can be employed in eliminating the expensive studding or other construction normally used in applying an overlay or finish surface. As will be apparent in FIG. 3, the stand-off elements may comprise small plastic members having T-shaped end portions and a body portion which extends through a small laterally extending notch 46 in the end flanges of building blocks.

Figure 12:
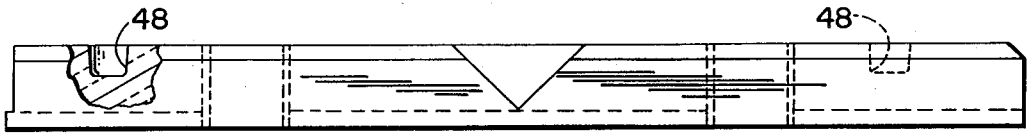
FIG. 12 is a top view thereof.
Figure 10:
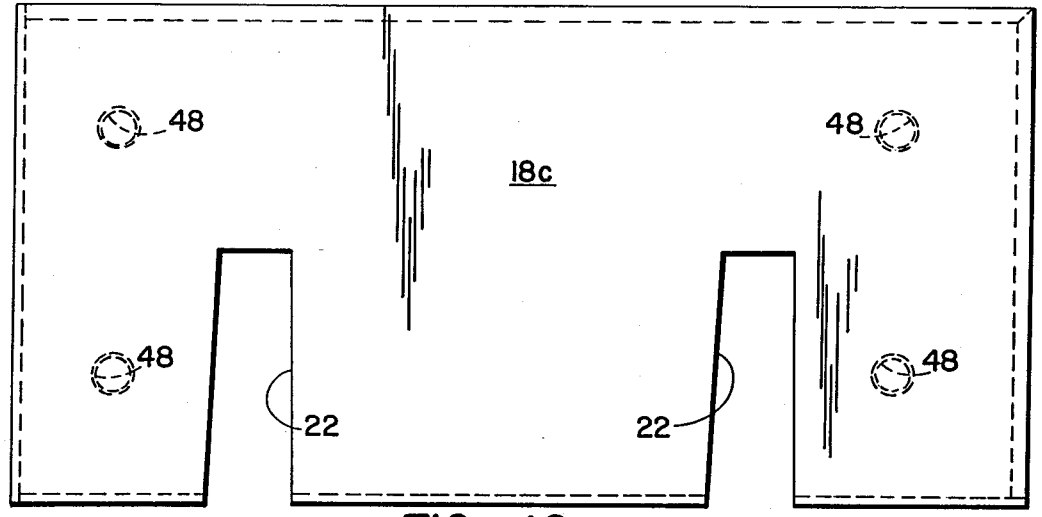
FIG. 10 is a side view of one part of an insulating insert having a plurality of small openings therein.
Figure 11:
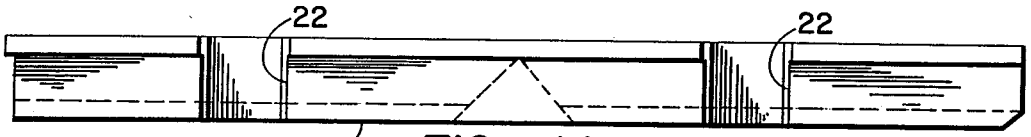
FIG. 11 is a bottom view of the insert of FIG. 10.
Figure 14:
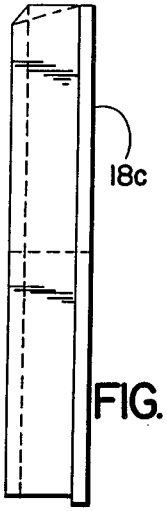
FIG. 14 is a lefthand end view thereof.
Figure 18:
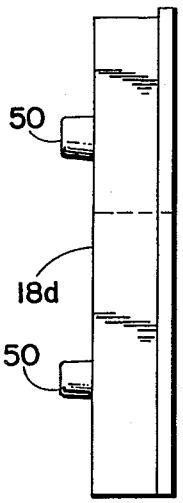
FIG. 18 is a righthand end view.
Figure 17:
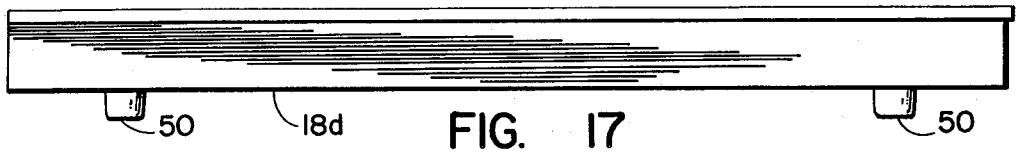
FIG. 17 is a top view thereof.
Figure 15:
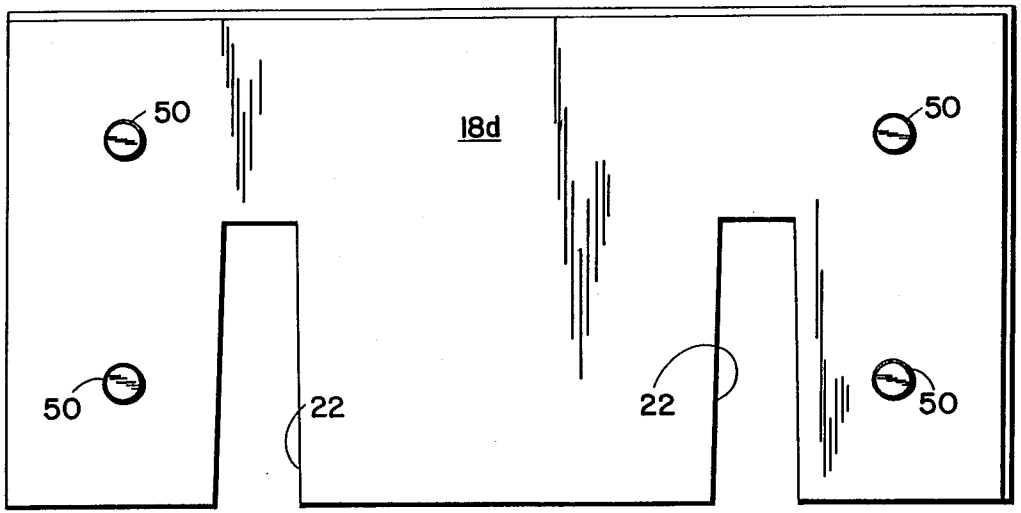
FIG. 15 is a side view of a second part of an insert having four small lugs thereon.
Figure 16:
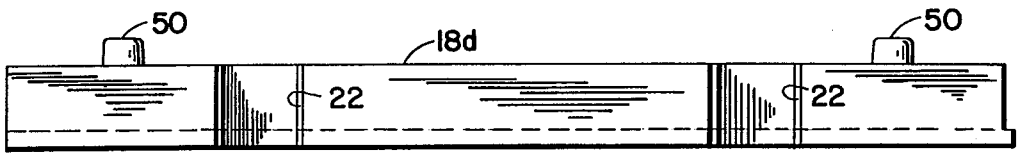
FIG. 16 is a bottom view of the insert of FIG. 15.
Figure 19:
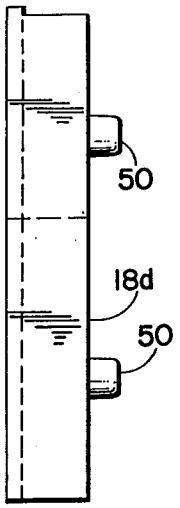
FIG. 19 is a lefthand end view.
Figure 22:
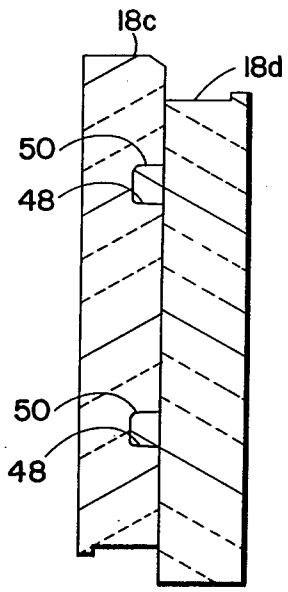
FIG. 22 is similar to FIG. 21 but shows said inert parts in a second position.
Figure 21:
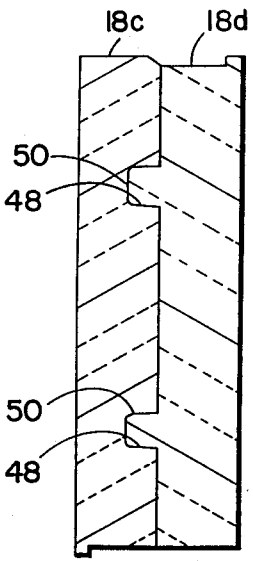
FIG. 21 is a vertical section view of the FIG. 10 and FIG. 15 insert parts in assembled relationship and in a first position.

Referring now to FIGS. 10 et sequa, a presently preferred form of a multi-part insert 18 is illustrated together with a presently preferred manufacturing method. Frangible means are provided for interconnecting and interengaging the parts of the multi-part insert and the insert is held in its aforementioned first position by such means but the means are readily ruptured manually in slidably moving the insert parts to the second position mentioned above. Referring particularly to FIG. 10, an insert part **18*c* is provided with at least one small opening and preferably with four equally spaced small openings 48,48. As best illustrated in FIG. 12, the openings 48 extend partially through the insert and are relatively small in size. In FIG. 15 et sequa, small lugs 50,50 are provided on an insert part 18*d* and are adapted to enter and substantially fit the openings 48,48 on the part 18*c*. Four such lugs are provided and when the insert is made of a light weight fragile material as for example expanded polystyrene, the lugs may be readily broken off or sheared in relative movement of the insert parts. Thus, referring to FIG. 21, it will be observed that lugs 50,50 are entered in the small openings 48,48 and the insert parts 18*c* and 18*d* are thus held in their first position. That is, the parts are held in alignment so as to reside wholly within the outline of the side walls of a block when inserted in a block. In FIG. 22, the portion 18*d* of the insert 18 has been moved downwardly as in FIG. 4, 8 above, and the small lugs 50,50** have been ruptured or broken off in the course of such movement.

As will be apparent, the use of the lug 50, opening 48 arrangement, particularly with a tight frictional fit, serves to retain the insert parts **18*c*, 18*d* in the assembled first position of FIG. 22. Thus, the handling and the insertion of the inserts into the building block at the block manufacturing plant is facilitated. The frangible nature of the lugs 50,50, provides for a ready movement of the parts in a sliding operation with slight downward manual pressure during the construction of a wall or the like as in FIGS. 4 and 8**.

Figure 20:
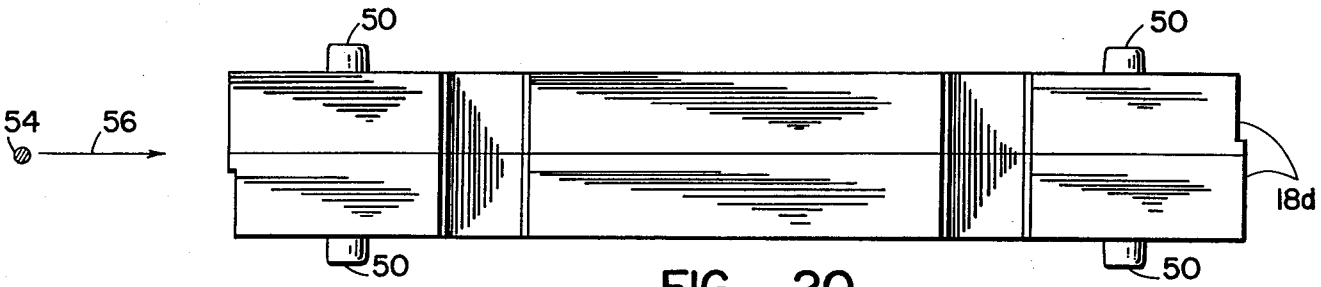
FIG. 20 is a top view of 2—2 of the insert parts of FIG. 15 which may be molded in unison and thereafter split along a plane intermediate there opposing faces.

In FIG. 20, a pair of the insert parts **18*d*,18*d* are shown manufactured in a single mold, with the lugs 50,50 oriented in opposite directions. As will be apparent, considerable economy in molding can be achieved in such a molding technique. Once the two parts 18*d*,18*d* have been molded in a single mold cavity, a hot wire or other cutting device 54 may be used to separate the parts 18*d*,18*d* along a plane intermediate the opposing surfaces thereof. Small arrow 56 indicates the direction of relative movement of a hot wire 54** in such operation.

As will be apparent from the foregoing, the improved building block and insulating insert of the present invention provide for minimum lateral heat transfer and a substantial improvement in U-Value. Moisture migration through the wall is minimized if not eliminated and even sound and air transmission charateristics are substantially improved. The building block may be manufactured with conventional mold structures and molding techniques and substantial economies are thus achieved. Finally, inaccuracies introduced by non-uniform mortar joints as with conventional blocks are eliminated. Thus, the present building blocks exhibit uniform mortar joints throughout by reason of the aforementioned uniform mortar grooves formed by the side wall flanges on the blocks.

I claim:

1. The combination of a preformed masonry building block and at least one preformed insulating insert therefor; said building block being adapted for use with similar blocks and inserts in vertically stacked horizontal rows in the contruction of structural walls and the like, and said block comprising a pair of laterally spaced longitudinally extending vertically disposed side walls each of a generally rectangular configuration viewed laterally and each of generally rectangular cross-sectional configuration, said walls cooperatively defining a vertically open generally rectanguar space therebetween, a pair of vertically disposed generally rectangular and laterally extending connecting arms disposed between and connected with said side walls at respective inner surfaces thereof whereby to secure the walls in relatively fixed position, said arms being spaced longitudinally from each other and from the ends of the walls and each arm including a vertically open notch adjacent a wall for receiving an insulating insert, said insulating insert being of a light weight thermal insulating and fire retarding material and having an external configuration which is generally rectangular, said insert having a pair of notches respectively for receiving portions of said arms of a block when the insert is disposed internally of and adjacent a wall thereof and entered vertically in the notches in the arms of the block, the insert being generally coextensive with the walls of the block and having no portion thereof projecting substantially beyond the walls of the block when so disposed in the block, and both block walls and said insulating insert having overlap and interlock means at least along each marginal end portion thereof so as to provide for overlapping and interlocking relationship between each block wall and insert and horizontally adjacent block walls and inserts in a structural wall or the like formed of similar blocks and inserts.

2. The combination of a preformed masonry building block and preformed insulating insert therefor as set forth in claim 1 wherein said insulating insert is adapted for quadrilateral overlapping and interlocking relationship with all contiguous inserts thereabout in a structural wall formed of similar blocks and inserts.

3. The combination of a preformed masonry building block and preformed insulating insert therefor as set forth in claim 2 wherein said insert is of multi-part planar construction with the parts relatively slidable so as to be arranged in a first position wherein both parts reside substantially wholly within the rectangular outline of the side walls of an associated block and in a second position wherein one of the parts is moved relative to the other part so as to project vertically into overlapping relationship with a vertically adjacent insert.

4. The combination of a preformed masonry building block and preformed insulating insert therefor as set forth in claim 3 wherein said overlap and interlocking means on said block side walls comprise thin narrow marginal flanges which extend from opposite surfaces of the side walls at opposite ends thereof, and wherein the overlap and interlock means on the insert comprise similar thin narrow marginal flanges.

5. The combination of a preformed masonry building block and preformed insulating insert therefor as set forth in claim 4 wherein the bottom edge surfaces of said block side walls are flat with the top edge surfaces thereof having thin narrow marginal flanges projecting from inner surfaces of the walls and defining uniform mortar receiving grooves outwardly thereof and extending horizontally between vertically adjacent blocks.

6. The combination of a preformed masonry building block and preformed insulating insert therefor as set forth in claim 4 wherein the two planar parts of said insulating insert have notches of slightly different depth so as to permit the relative downward sliding movement of one of said parts into said overlapping and interlocking relationship with an adjacent insert.

7. The combination of a preformed masonry building block and preformed insulating insert therefor as set forth in claim 6 wherein said multi-part insulating insert is provided with interengaging means serving to secure the parts of the insert initially in said first position wherein both parts of the insert reside substantially within the rectangular outline of the side walls of an associated block, and wherein said means is fragile so as to be readily ruptured and release the parts of the insert for relative sliding movement to the second position of the parts with one part of the insert in overlapping and interlocking relationship with a subadjacent insert.

8. The combination of a preformed masonry building block and at least one preformed insulating insert therefor; said building block being adapted for use with similar blocks and inserts in vertically stacked horizontal rows in the construction of structural walls and the like, and said block comprising a pair of laterally spaced longitudinally extending vertically disposed side walls each of a generally rectangular configuration viewed laterally and each of generally rectangular cross-sectional configuration, said walls cooperatively defining a vertically open generally rectangular space therebetween, a pair of vertically disposed generally rectangular and laterally extending connecting arms disposed between and connected with said side walls at respective inner surfaces thereof whereby to secure the walls in relatively fixed position, said arms being spaced longitudinally from each other and from the ends of the walls and each arm including a vertically open notch adjacent a wall for receiving an insulating insert, said insulating insert being of a light weight thermal insulating and fire retarding material and having an external configuration which is generally rectangular, said insert having a pair of notches respectively for receiving portions of said arms of a block when the insert is disposed internally of and adjacent a wall thereof and entered vertically in the notches in the arms of the block, and the insert being of multi-part planar construction with the parts relatively slidable so as to be arranged in a first position wherein both parts reside substantially-wholly within the rectangular outline of the side walls of an associated block and in a second position wherein one of the parts is moved relative to the other part so as to project vertically downwardly into overlapping relationship with a vertically adjacent insert.

* * * * *